United States Patent [19]

Pehl et al.

[11] Patent Number: 4,955,204

[45] Date of Patent: Sep. 11, 1990

[54] CRYOSTAT INCLUDING HEATER TO HEAT A TARGET

[75] Inventors: Richard H. Pehl, Berkeley; Norman W. Madden, Livermore; Donald F. Malone, Oakland, all of Calif.

[73] Assignee: The Regents of the University of California, Oakland, Calif.

[21] Appl. No.: 434,249

[22] Filed: Nov. 9, 1989

[51] Int. Cl.[5] ..... F25B 19/00

[52] U.S. Cl. ..... 62/51.1; 62/46.3; 250/352

[58] Field of Search ..... 62/46.3, 51.1, 55.5; 250/352

[56] References Cited

U.S. PATENT DOCUMENTS

| | | | |
|---|---|---|---|
| 3,398,549 | 8/1968 | Zobel | 62/51.1 |
| 3,525,228 | 8/1970 | Anderson | 62/51.1 |
| 3,611,746 | 10/1971 | Marsing et al. | 62/51.1 |
| 4,068,495 | 1/1978 | Alger et al. | 62/51.1 |
| 4,218,892 | 8/1980 | Stephens et al. | 62/51.1 |
| 4,658,601 | 4/1987 | Burchell et al. | 250/352 |
| 4,766,313 | 8/1988 | Homma et al. | 250/289 |

*Primary Examiner*—Ronald C. Capossela

*Attorney, Agent, or Firm*—Flehr, Hohbach, Test, Albritton & Herbert

[57] ABSTRACT

A cryostat is provided which comprises a vacuum vessel; a target disposed within the vacuum vessel; a heat sink disposed within the vacuum vesssel for absorbing heat from the detector; a cooling mechanism for cooling the heat sink; a cryoabsorption mechanism for cryoabsorbing residual gas within the vacuum vessel; and a heater for maintaining the target above a temperature at which the residual gas is cryoabsorbed in the course of cryoabsorption of the residual gas by the cryoabsorption mechanism.

28 Claims, 2 Drawing Sheets

CRYOSTAT INCLUDING HEATER TO HEAT A TARGET

GOVERNMENT CONTRACT INFORMATION

The U.S. Government has a paid-up license in this invention and the right in limited circumstances to require licenses to others on reasonable terms as provided for by the terms of Contract No. DE-AC03-76SF 00098 awarded by the U.S. Department of Energy.

BACKGROUND OF THE INVENTION

1. Field of the Invention

The invention relates generally to cryostats and more particularly to cryostats that include detectors that operate at very low temperatures.

2. Description of the Related Art

A cryostat is an apparatus that provides a low temperature working environment required for devices that operate at very low temperatures. A typical cryostat includes a vacuum vessel that encloses a detector such as a measurement instrument, that operates at very low temperatures. A cryostat also includes a cooling mechanism for cooling the detector.

Frequently, it is desirable to remove from a cryostat vacuum vessel residual gases, such as water, oxygen, carbon dioxide and nitrogen, for example. Such residual gases often can contaminate a detector and degrade its performance. In particular, at reduced temperatures, residual gas tends to be cryoabsorbed by cold surfaces within the vacuum vessel. Cryoabsorption is a phenomenon whereby a warmer gas tends to be absorbed by a cooler surface. Such cryoabsorption on surfaces of a detector within a cryostat vacuum vessel often can have deleterious effects upon operation of such a detector. For example, germanium detector diodes used for detecting high energy photons in the form of X-rays and gamma-rays must be virtually free of surface contaminants in order to avoid leakage current which degrades detector performance. Cryoabsorption of residual gases by such diodes causes surface contamination which degrades their performance. Moreover, it should be noted that a detector, such as a germanium diode, for example, can be damaged through contamination to the extent it must be removed from the cryostat for reprocessing before it can be used again.

In the past, residual gas in a vacuum vessel of a cryostat has been removed, for example, by employing a cryoabsorb such as activated Zeolite or activated charcoal which at low temperatures, readily absorbs the residual gas. A typical cryoabsorb provides a relatively large bonding surface for the residual gas, and at low temperatures, such cryoabsorbs remove the residual gas through bonding ("absorption") of the residual gas by such cryoabsorbing bonding surfaces. Thus, in the ideal case the residual gas is cryoabsorbed by the cryoabsorb instead of by a detector within the vacuum vessel.

While earlier cryostats generally have been acceptable, there have been problems with their use. For example, while cryoabsorbs can successfully absorb residual gases, they also tend to deabsorb these gases when temperatures increases again. Furthermore, typically, as temperatures within the vacuum vessel increase, the detectors heat up the most slowly. Consequently, there is a risk that as the temperature increases, the deabsorbed residual gas will be recryoabsorbed by a relatively cool detector resulting in contamination of the detector surface.

One earlier solution to this problem was to pump out such deabsorbed residual gas during such temperature increases so that it could not be recryoabsorbed by a detector within the vacuum vessel. Another solution was to coat a detector, such as a germanium detector diode, with an electrically inert material such as silicon monoxide, for example, that could inhibit the effect of cryoabsorbed residual gas. Neither of these solutions has been totally satisfactory. The first generally requires the use of equipment such as an external vacuum pump to remove residual gas from the vacuum vessel of a cryostat. Often such a pump cannot be conveniently transported to remote locations where the cryostat can be used. The second often still results in unacceptable degradation of detector performance.

Still another problem involved cryostats that employed devices such as germanium detector diodes to detect physical phenomena such as high energy photons. More specifically, germanium diodes of the type mentioned above, for example, not only must be virtually free of surface contamination but also must have virtually perfect crystal lattice structures in order to perform satisfactorily. In operation, however, the bombardment of the germanium crystal lattice by high energy particles can cause damage to the lattice structure which can result in degradation of the ability of the diode to detect. The lattice structure usually can be repaired through annealing; that is accomplished by raising the temperature of the germanium diode to approximately 400° K. for approximately twenty-four hours.

Thus, there has been a need for an improved cryostat in which temperatures can be raised above low temperature levels without undue risk of contaminating detectors through cryoabsorption of residual gases on the surface of the detectors. Furthermore, there has been a need for such a cryostat in which a device, such as a germanium detector diode, for example, can be annealed in situ without the need to attach an external pump to the cryostat. The present invention meets these needs.

SUMMARY OF THE INVENTION

In one aspect, the invention comprises a novel cryostat. In a presently preferred embodiment, the novel cryostat includes a vacuum vessel. A heat sink and a target are disposed within the vacuum vessel. The target is disposed adjacent to the heat sink. A cooling apparatus cools the heat sink which, in turn, absorbs heat from the target. A cryoabsorb cryoabsorbs residual gas from within the vacuum vessel. In the course of cryoabsorption of the residual gas by the cryoabsorb, a heater maintains the target surface above a temperature at which the residual gas can be cryoabsorbed by the target surface.

In another aspect, the present invention also provides a novel method in which a heat sink disposed within a vacuum vessel of a cryostat is cooled using a cooling mechanism. Residual gas within the vacuum vessel is cryoabsorbed using a cryoabsorb. Meanwhile, in the course of the step of cryoabsorbing, a target within the vacuum vessel is heated so as to maintain the target above a temperature at which the residual gas can be cryoabsorbed by the target surface.

Thus, sensitive detectors disposed within a vacuum vessel of the inventive cryostat advantageously can be cooled substantially without the risk that the detectors or other target surfaces will be damaged by cryoabsorption of residual gas within the vacuum vessel. Moreover, the detectors or other target surfaces also can be reheated after cooling substantially without risk of cryoabsorption. Furthermore, by heating a detector, which for example can be a germanium diode, the detector can be annealed in situ.

BRIEF DESCRIPTION OF THE DRAWINGS

The purpose and advantages of the present invention will be apparent to those skilled in the art from the following detailed description in conjunction with the appended drawings in which.

DETAILED DESCRIPTION OF THE PREFERRED EMBODIMENT

The present invention comprises a novel cryostat 10 and an associated method. The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded the widest scope consistent with the principles and features disclosed herein.

Figure 1:
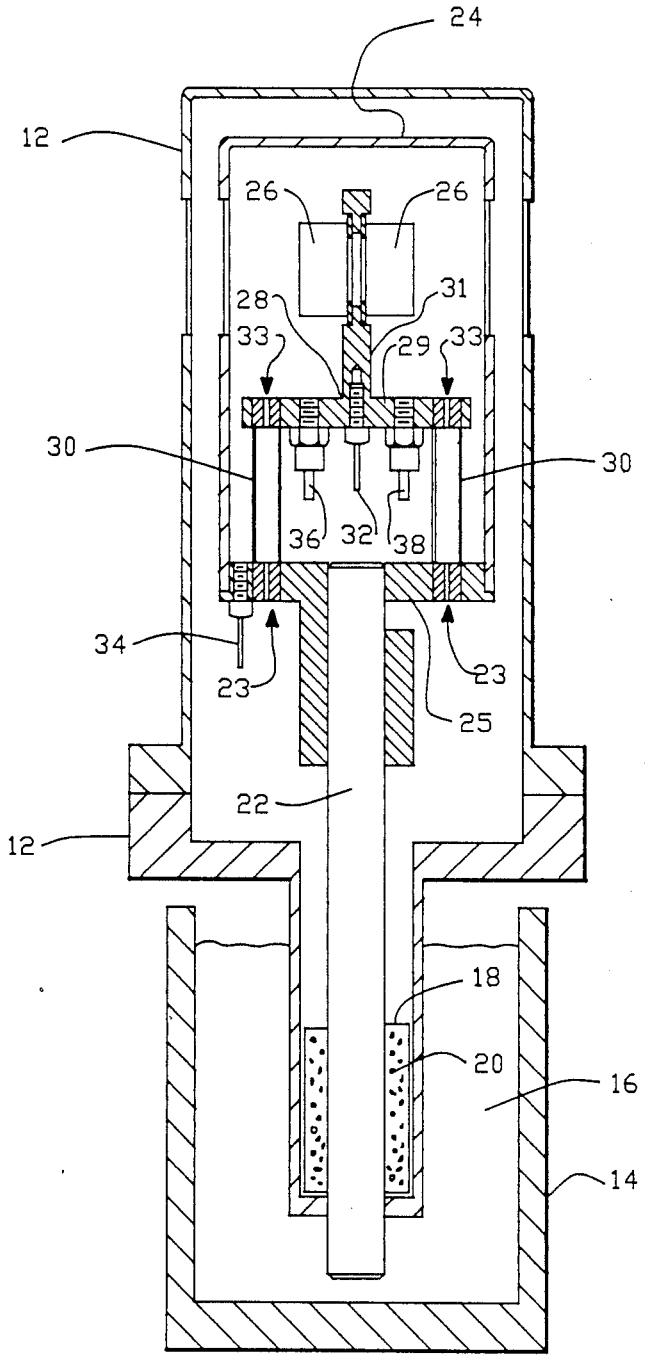
FIG. 1 is a cross-sectional view of a cryostat of a presently preferred embodiment of the invention.

Referring now to the illustrative drawings of FIG. 1, there is shown a cross-sectional view of a presently preferred embodiment of a cryostat 10 in accordance with the invention. The paper by Pehl et al. entitled "A Variable Temperature Cryostat That Produces In Situ Clean-Up of Germanium Detector Surfaces" published in Vol. 36, No. 1, *I.E.E.E. Nuclear Science Transactions,* pages 190–193, February, 1989, generally describes a cryostat in accordance with the invention, and is expressly incorporated herein in its entirety by this reference. The cryostat 10 includes a generally cylindrical vacuum vessel 12, a dewar 14 containing a cryogen 16 and a container 18 having a porous surface disposed within the vacuum vessel and containing a cryoabsorb 20. A cold finger 22 provides thermal communication between the cryogen 16 within the dewar 14 and a vacuum environment within the vacuum vessel 12.

In the presently preferred embodiment the cryogen 16 is liquid nitrogen ($LN_2$) which is at a temperature of 77° K. at normal atmospheric pressure. Alternatively, the cryogen could be liquid Argon, for example. A cryogen is a cooled material used to cool other materials placed in thermal contact with it. While the present embodiment uses a cryogen to achieve very cool temperatures, it will be appreciated that alternative cooling mechanisms such as a mechanical compressor could be employed.

The cryoabsorb 20 is Zeolite material. Alternatively, for example, activated charcoal could be used.

A heat sink 24 in the form of a substantially cylindrical enclosure is coaxially mounted on the cold finger 22 within the vacuum vessel 12 such that the heat sink 24 is in thermal contact with the cold finger 22. Germanium detector diodes 26 (two are shown) are mounted on a detector mount 28 within the heat sink enclosure 24. Alternative detectors in accordance with the invention include silicon diodes or other low noise detector devices, for example. The detector mount 28 is coaxially supported within the enclosure 24 by thin elongated hollow cylindrical supports 30 (two are shown).

The detector mount 28 includes a substantially circular transverse portion 29 and an upstanding portion 31. Respective holes 33 are formed in the transverse portion 29 of the detector mount 28, and corresponding holes 23 are formed in a base portion 25 of the heat sink enclosure 24. The respective detector mount holes 33 and the corresponding enclosure base holes 23 are aligned with each other and with the support tubes 30 such that residual gas within the vacuum vessel 12 can pass between an interior and an exterior of the enclosure 24, as explained more fully below.

A first temperature sensing diode 32 is secured to the detector mount 28 within the heat sink enclosure 24. A second temperature sensing diode 34 is secured directly to the base portion 25 of the exterior of the heat sink enclosure 24 within the vacuum vessel 12. In the presently preferred embodiment, the first and second temperature sensing diodes 32, 34 can be either silicon switching diodes or emitter-base diodes of silicon metal canned transistors. Alternative temperature sensors include thermocouples, thermistors and platinum resistance thermometers, for example.

First and second heater diodes 36, 38 are secured to the detector mount 28 within the enclosure 24. In the presently preferred embodiment, the first and second heater diodes 36, 38 are 100 volt (at room temperature) Zener diodes. Alternative heaters include resistors or heating coils, for example. Zener diodes, in a 10 Watt stud package, in which the silicon chip (diode) is eutectically bonded to a copper stud provide good thermal coupling of the diode heating element to the detector mount 28. Moreover, in a forward-biased mode the first and second heater diodes 36, 38 advantageously can be used to measure temperature, providing a back-up temperature sensor in case of failure of the first temperature sensing diode 32.

The vacuum vessel 12, the heat sink 24, the detector mount and the cold finger 22 are formed from thermal conductive materials. Of course, there is no need for the vacuum vessel 12 to be thermally conductive. The support tubes 30 are formed from a thermal impedance material. In the presently preferred embodiment, the vacuum vessel 12, the heat sink 24 and the detector mount 28 all are formed from aluminum. The cold finger 22 is formed from copper. The support tubes 30 are formed from thin stainless steel.

In operation, a vacuum typically is maintained within the vacuum vessel 12 even at ambient temperatures when the cryogen 16 is removed from thermal contact with the cold finger 22. When the cryogen 16 is placed in thermal contact with the cold finger 22, the cold finger 22 is cooled to approximately the temperature of the cryogen 16. The cold finger 22 provides a thermal conduit from the cryogen 16 to the heat sink 24, which allows the heat sink 24 also to become cooled approximately to the temperature of the cryogen 16.

As the heat sink enclosure 24 is cooled, heat from the detector diodes 26 radiates to the sink 24. The relatively high thermal impedance of the support tubes 30 results in a relatively slow rate of heat transfer through heat conduction by the tubes 30 from the detector diodes 26 and the mount 28 to the base portion 25 of the sink 24. As will be explained more fully below, the relatively low rate of heat transfer by the tubes 30 advantageously permits the detector diodes 26 and the mount 28 to be heated without requiring excessive power to be dissipated by the heater diodes, 36, 38.

It will be appreciated that residual gases such as water, carbon monoxide, carbon dioxide, oxygen and nitrogen typically reside within the vacuum vessel and within the heat sink enclosure 24. As internal components of the cryostat 10 are cooled, these residual gases tend to be cryoabsorbed by surfaces within the vacuum vessel 12. More particularly, each residual gas has a characteristic temperature at which cryoabsorption ordinarily occurs. Of course, the characteristic temperature of cryoabsorption for each gas can vary with a number of different factors such as the partial pressure of the gas within the vacuum vessel 12.

As will be understood from the drawings of FIG. 1, the cold finger 22 thermally couples the cryoabsorb 20 to the cryogen 16. As the cryoabsorb 20, is cooled, it cryoabsorbs more and more residual gas within the vacuum vessel 12. Residual gas within the heat sink enclosure 24 can pass from inside the enclosure 24 through the aligned detector mount holes 33 and enclosure base holes 23 and support tubes 30 to outside the enclosure 24 within the vacuum vessel 12.

During the time in which the cryoabsorb 20 is cryoabsorbing such residual gas from within the vacuum vessel 12, the first and second heater diodes 36, 38 advantageously heat the germanium detector diodes 26 to maintain them at a sufficiently elevated temperature such that none of the residual gas within the vacuum vessel 12 or within the heat sink enclosure 24 can be cryoabsorbed by the detector diodes 26. Actually, the first and second heater diodes 36, 38 heat the detector mount 28 to which the detector diodes 26 are secured, and the detector diodes 26 absorb heat from the detector mount 28. At equilibrium, the detector mount 28 and the detector diodes 26 are substantially at the same temperature.

Figure 2:
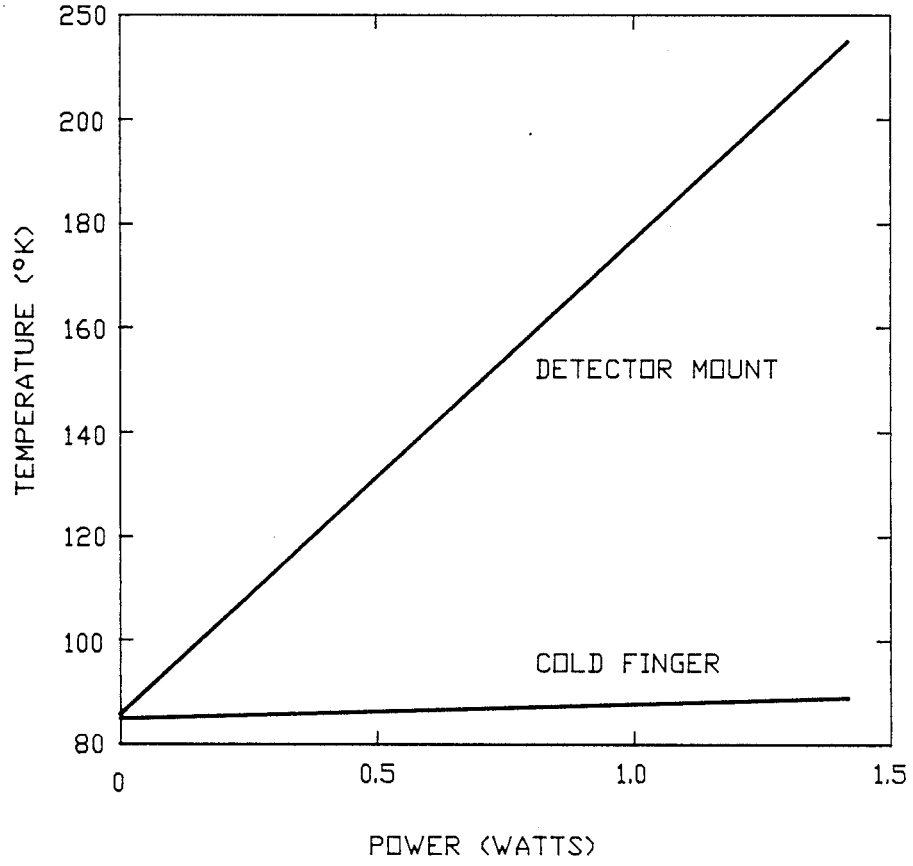
FIG. 2 is a graph showing temperatures of the detector mount and of the heat sink as a function of heater diode power dissipation for the cryostat of FIG. 1.

FIG. 2 shows a curve that illustrates temperatures of the detector mount 28 and the cold finger 22 as a function of power dissipated by the first and second heater diodes 36, 38. Typically, the detector diodes 26 are maintained at a temperature which exceeds the temperature of cryoabsorption of the residual gas that has the highest characteristic temperature of cryoabsorption. Since water usually is the residual gas having the highest temperature of cryoabsorption, the detector diodes 26 ordinarily are maintained at a temperature of approximately 300° K. plus. That temperature is maintained at least until the cryoabsorb 20 has absorbed enough of the residual gas to substantially avoid the risk of cryoabsorption by the detector diodes 26.

Once the cryoabsorb 20 has absorbed sufficient residual gas to reduce the risk of contaminating the detector diodes, the first and second heater diodes 36, 38 are shut off, and the temperature of the germanium diodes 26 is allowed to drop to approximately the temperature level of the cryogen 16.

Thus, by maintaining the detector diodes 26 at an elevated temperature during cryoabsorption of residual gas by the cryoabsorb 20, it is ensured that such residual gas is not absorbed by the germanium diodes 26 themselves. Consequently, a cooled vacuum environment can be formed within the vacuum vessel 12 substantially without risk of cryoabsorption contamination of sensitive detectors within the vacuum vessel 12.

In the course of the cryoabsorption process, while the germanium diodes 26 are being heated, the first temperature sensing diode 32 is used to sense the temperature of the germanium diodes 26, and the second temperature sensing diode 34 is used to sense the temperature of the base portion 25 of the heat sink 24. These temperature measurements, for example, are used to maintain the temperature of the detector diodes 26 and to prevent overheating. In the presently preferred embodiment, a servo-mechanism (not shown) is used to regulate the power dissipated by the heater diodes 36,38 based upon the temperature sensed by the first and second temperature sensing diodes 32,34. Servo-mechanisms of this type are well known to those skilled in the art and need not be described herein.

Once the residual gas is removed and the detector diodes are cooled, detection can begin. A relatively large reverse bias, on the order of approximately 4000 volts, is applied to the detector diodes 26 so as to produce a relatively wide depletion region in each diode. This depletion region serves as a target for bombardment by gamma-rays and X-rays. In the presently preferred embodiment, the detector diodes 26 are almost always used in a fully depleted mode. The cryostat 10 is placed suitably close to a subject, such as a radioactive material, to be tested for X-ray or gamma-ray photon emissions. The vacuum vessel 12 and the heat sink enclosure 24 are nearly transparent to such emissions. As X-rays or gamma rays collide with atoms in the depletion regions of the detector diodes, electron-hole pairs are produced. Since the electric field is so strong in the depletion region, free electrons are swept to a positive voltage terminal, and free holes are swept to a negative voltage terminal before they have a chance to recombine. A measure of the resulting current provides useful information about the subject under test.

The walls of the heat sink enclosure 24 provide a barrier to infrared radiation emitted by the vacuum vessel 12 which would detrimentally alter the performance of the detector diodes 26.

It will be appreciated that, after detecting is completed, it may be desirable to increase the temperature of components of the cryostat 10 as, for example, when the cryogen 16 is removed from thermal contact with the cold finger 22. As the cryoabsorb 20 heats up, it tends to "deabsorb" the residual gas. Thus, there is a risk that such deabsorbed residual gas can be recryoabsorbed by the detector diodes 26 before the detector diodes 26 become sufficiently warm to avoid cryoabsorption. To eliminate this danger, the heater diodes 36, 38 can be used during such reheating to warm the detector diodes 26 sufficiently to avoid such recryoabsorption.

Moreover, it will be appreciated that by heating the germanium diodes to temperatures of approximately 400° K., they can be annealed "in situ" without the need to remove them from their experimental locations and attach them to an external pump. Therefore, crystal lattice damage routinely suffered from bombardment by high-energy particles such as neutrons and protons can be repaired relatively easily.

It will be appreciated that while one particular embodiment of the invention has been described in detail, various alternative embodiments such as a cryostat using detectors formed from InSb can be produced without departing from the invention. Moreover, virtually any pristine target surface to be observed at very low temperatures can be substituted for the detectors. Such a pristine target surface, like the detectors described above, would be susceptible to surface contamination due to Cryoabsorption, and the principles of the present invention can be employed to prevent such contamination. Such a pristine target surface, for example, could be cooled to very low temperatures for observation by an electron microscope.

Thus, the above description of a presently preferred embodiment is not intended to limit the scope of the invention which is described in the appended claims.

What is claimed is:

1. A cryostat comprising:
a vacuum vessel;
a target disposed within said vacuum vessel;
heat sink means disposed within said vacuum vessel for absorbing heat from said target;
cooling means for cooling said heat sink means;
cryoabsorption means for cryoabsorbing residual gas within said vacuum vessel; and
heater means for maintaining said target above a temperature at which the residual gas is cryoabsorbed in the course of cryoabsorption of the residual gas by said cryoabsorption means.

2. The cryostat of claim 1 wherein said target is part of detector means.

3. The cryostat of claim 2 and further including:
wherein said heat sink means includes barrier means for substantially preventing infrared radiation from reaching said target.

4. The cryostat of claim 3 wherein said barrier means substantially encloses said target and defines at least one conduit for providing communication of residual gas between regions interior to and regions exterior to said enclosure means within said vacuum vessel.

5. The cryostat of claim 1 wherein said cooling means includes cryogenic cooling means for cryogenically cooling said, heat sink means.

6. The cryostat of claim 5 and further including:
thermal coupling means for thermally coupling said heat sink means to said cryogenic cooling means.

7. The cryostat of claim 5 and further including:
thermal coupling means for thermally coupling said heat sink means to said cryogenic cooling means and for thermally coupling said cryoabsorption means to said cryogenic cooling means.

8. The cryostat of claim 1 and further comprising:
support means for supporting said target within said vacuum vessel and for providing a relatively high impedance thermal path between said target and said heat sink means.

9. The cryostat of claim 7 wherein said support means is secured at one end to said target and at another end to said heat sink means.

10. The cryostat of claim 1, wherein said heater means also can maintain said detector means above the temperature at which the residual gas is cryodeabsorbed by said cryoabsorption means in the course of cryodeabsorption of the residual gas by said cryoabsorption means.

11. The cryostat of claim 1 and further including:
first temperature sensing means for sensing temperature of said target.

12. The cryostat of claim 11 wherein said first temperature sensing means includes at least one diode.

13. The cryostat of claim 1 and further including:
first temperature sensing means for sensing temperature of said target; and
second temperature sensing means for sensing temperature of said heat sink means.

14. The cryostat of claim 13,
wherein said first temperature sensing means includes at least one diode; and
wherein said second temperature sensing means includes at least one diode.

15. The cryostat of claim 1 wherein said heater means includes at least one diode.

16. A cryostat comprising:
a vacuum vessel;
a target disposed within said vacuum vessel;
heat sink means disposed within said vacuum vessel for absorbing heat from said target;
cryogenic cooling means for cryogenically cooling said heat sink means, said cryogenic cooling means including thermal coupling means for thermally coupling said cryogenic cooling means to said heat sink means;
cryoabsorption means for cryoabsorbing residual gas within said vacuum vessel;
heater means for maintaining said detector means above a temperature at which the residual gas is cryoabsorbed in the course of cryoabsorption of the residual gas by said cryoabsorption means; and
support means for supporting said target within said vacuum vessel and for providing a relatively high impedance thermal path between said target and said heat sink means.

17. The cryostat of claim 16 wherein and further including:
said support means includes at least one portion formed from a first material; and
said heat sink means is formed at least in a significant part from a second material having a greater thermal conductivity than the first material.

18. The cryostat of claim 17 wherein the first material is stainless steel and the second material is aluminum.

19. The cryostat of claim 16 and further including:
first temperature sensing means for sensing temperature of said target.

20. The cryostat of claim 16 wherein said heater means includes at least one diode.

21. The cryostat of claim 16 and further including second temperature sensing means for sensing temperature of said heat sink means.

22. A cryostat comprising:
a vacuum vessel;
detector means disposed within said vacuum vessel;
heat sink means disposed within said vacuum vessel for absorbing heat from said detector means;
barrier means for substantially preventing infrared radiation from reaching said detector means;
cryogenic cooling means for cryogenically cooling said heat sink means, said cryogenic cooling means including thermal coupling means for thermally coupling said cryogenic cooling means to said heat sink means;
cryoabsorption means for cryoabsorbing residual gas within said vacuum vessel;
heater means for maintaining said detector means above a temperature at which the residual gas is cryoabsorbed in the course of cryoabsorption of the residual gas by said cryoabsorption means; and
support means for supporting said detector means within said vacuum vessel and for providing a relatively high impedance thermal path between said detector means and said heat sink means.

23. The cryostat of claim 22 and further including:

temperature sensing means for sensing temperature of said detector means; and temperature sensing means for sensing temperature of said heat sink means.

24. In a cryostat including, a vacuum vessel; a target disposed within the vacuum vessel; heat sink means disposed within the vacuum vessel for absorbing heat from the target; cooling means for cooling the heat sink means; cryoabsorption means for cryoabsorbing residual gas within the vacuum vessel, a method for removing residual gas from the vacuum vessel comprising the steps of:

cooling the at least one heat sink means using the cooling means;

cryoabsorbing residual gas within the vacuum vessel using the cryoabsorption means;

heating the target in the course of said step of cryoabsorbing so as to maintain the target surface above a temperature at which the residual gas is cryoabsorbed.

25. The method of claim 24 and further including the step of:

cooling the target using the heat sink means after said step of cryoabsorbing.

26. The method of claim 24 and further including the step of:

sensing temperature of the target.

27. The method of claim 24 and further including the steps of:

sensing temperature of the target; and sensing temperature of the heat sink means.

28. The method of claim 24 and further including the steps of:

after said steps of cooling, cryoabsorbing and said first step of heating, heating the heat sink means; and heating the target in the course of said step of heating the heat sink means so as to maintain the target surface above a temperature at which the residual gas is cryoabsorbed.

* * * * *